US006570116B2

(12) United States Patent
Maulandi et al.

(10) Patent No.: US 6,570,116 B2
(45) Date of Patent: May 27, 2003

(54) CURRENT CARRYING ASSEMBLY FOR A CIRCUIT BREAKER

(75) Inventors: Aymon A. Maulandi, Cedar Rapids, IA (US); Timothy R. Faber, Marion, IA (US); Laurent Aureyre, Crolles (FR); Cameron L. Woodson, Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/931,368

(22) Filed: Aug. 16, 2001

(65) Prior Publication Data

US 2003/0034332 A1 Feb. 20, 2003

(51) Int. Cl.[7] ..... H01H 33/18
(52) U.S. Cl. ..... 218/22; 335/16
(58) Field of Search ..... 218/22–27; 335/16, 335/147, 195

(56) References Cited

U.S. PATENT DOCUMENTS 3,721,784 A * 3/1973 Viracola ..... 200/250
4,891,617 A * 1/1990 Beatty et al. ..... 335/157
5,793,270 A * 8/1998 Beck et al. ..... 218/154
5,874,874 A * 2/1999 Helms et al. ..... 200/244
5,889,249 A 3/1999 Rival et al. ..... 218/149
6,218,636 B1 4/2001 Blancfene et al. ..... 218/158

FOREIGN PATENT DOCUMENTS

EP 0022708 B1 10/1983 ..... H01H/73/18

OTHER PUBLICATIONS

Abstract for EP22708 Oct. 5, 1983.

* cited by examiner

*Primary Examiner*—Elvin Enad
*Assistant Examiner*—M. Fishman
(74) *Attorney, Agent, or Firm*—Larry I. Golden

(57) ABSTRACT

A blade assembly for use in a circuit breaker, the blade assembly comprising a plurality of blades, including one or more pairs of adjacent side-by-side blades having coplanar contact surfaces and coplanar bearing surfaces, at least one set of blade springs, each having one end in operative contact with the bearing surface of each of a pair of adjacent side-by-side blades, the at least one set of blade springs comprising at least one compression spring.

27 Claims, 5 Drawing Sheets

CURRENT CARRYING ASSEMBLY FOR A CIRCUIT BREAKER

FIELD OF THE INVENTION

This invention is directed generally to the field of devices for making and breaking electrical contacts in relatively high voltage environments and more particularly to an improvement in a current carrying assembly for a circuit breaker.

BACKGROUND OF THE INVENTION

While the current invention may find other uses, such as in switches, contactors, connectors, and the like, the invention will be described herein with reference to a circuit breaker for relatively high voltage applications. The specific circuit breaker described herein is of the type generally known as a hybrid ICL circuit breaker. One such circuit breaker is made by Schneider Electric/Square D Company under the designation PROXIMA™ C5.

In such circuit breakers, a number of blades in a moveable pole or blade assembly are arranged to make and break contact with a fixed contact in order to close or open the circuit between the two terminals of the breaker. In order to assure good contact pressure when the breaker is closed, one or more springs are provided to compress the contacts of the moveable pole assembly against the fixed contact. Generally speaking, this has been done by using a compression spring associated with each of the multiple blades of the moveable contact or pole assembly. However, because the blades are spaced in relatively close parallel alignment, the space available for a spring relative to each blade is limited. Therefore, relatively small sized springs have been selected and used heretofore for this application. If it were possible to increase the size (volume) of the springs, more desirable spring characteristics chould be obtained, such as lower spring rate, lower stress concentration factors, and the like.

In addition, during high-level short circuits there can be a relatively large quantity of molten metal and/or plasma circulating in proximity to the blade springs. Accordingly, it is desirable to provide some protective barrier to shield the springs, at least in part, from this material under such conditions. Moreover, during high in-rush currents (up to 12 times the nominal current rating of the breaker) the temperature of the blades can exceed the recommended working temperature of the spring. Such conditions can last for several seconds. Accordingly, it is desirable to provide some means to protect the springs from heat transfer from the blades during such conditions.

OBJECTS OF THE INVENTION

Accordingly, it is a general object of the invention to provide a circuit breaker assembly having a blade spring configuration which addresses the above-noted considerations.

More specifically, it is an object of the invention to provide a breaker design in which the blade springs of larger size can be utilized in order to increase the available volume, allow for better shape in a relatively larger spring having more desirable characteristics such as lower spring rate, lower stress concentration factors, and the like. In addition, the springs, when somewhat larger are able to bend enough to provide enough independent force to each blade of the multiple blade assembly, so as to compensate for differences in wear and in manufacturing variables and tolerances commonly encountered in such assemblies.

Another object of the invention is to provide a protective device for protecting the blade springs both from materials that may be ejected during high-level short circuits, as well as from excessive heat transfer during high in-rush current conditions.

SUMMARY OF THE INVENTION

Briefly, in accordance with the foregoing, a blade assembly for use in a circuit breaker, said blade assembly comprising a plurality of blades, including one or more pairs of adjacent side-by-side blades having coplanar contact surfaces and coplanar bearing surfaces, at least one set of blade springs, each set having one end in operative contact with said bearing surface of each of a pair of adjacent side-by-side ones of said blades, said at least one set of blade springs comprising at least one compression spring.

In another embodiment of the foregoing, a blade assembly for use in a circuit breaker, said blade assembly comprising means for directing the current through a plurality of blades, including one or more pairs of adjacent side-by-side blades having coplanar contact surfaces and coplanar bearing surfaces, and means for providing a loading force on said blades using at least one set of blade springs, each having one end in operative contact with said bearing surface of each of a pair of adjacent side-by-side blades, said at least one set of blade springs comprising at least one compression spring.

DETAILED DESCRIPTION OF THE ILLUSTRATED EMBODIMENT

Figure 1:
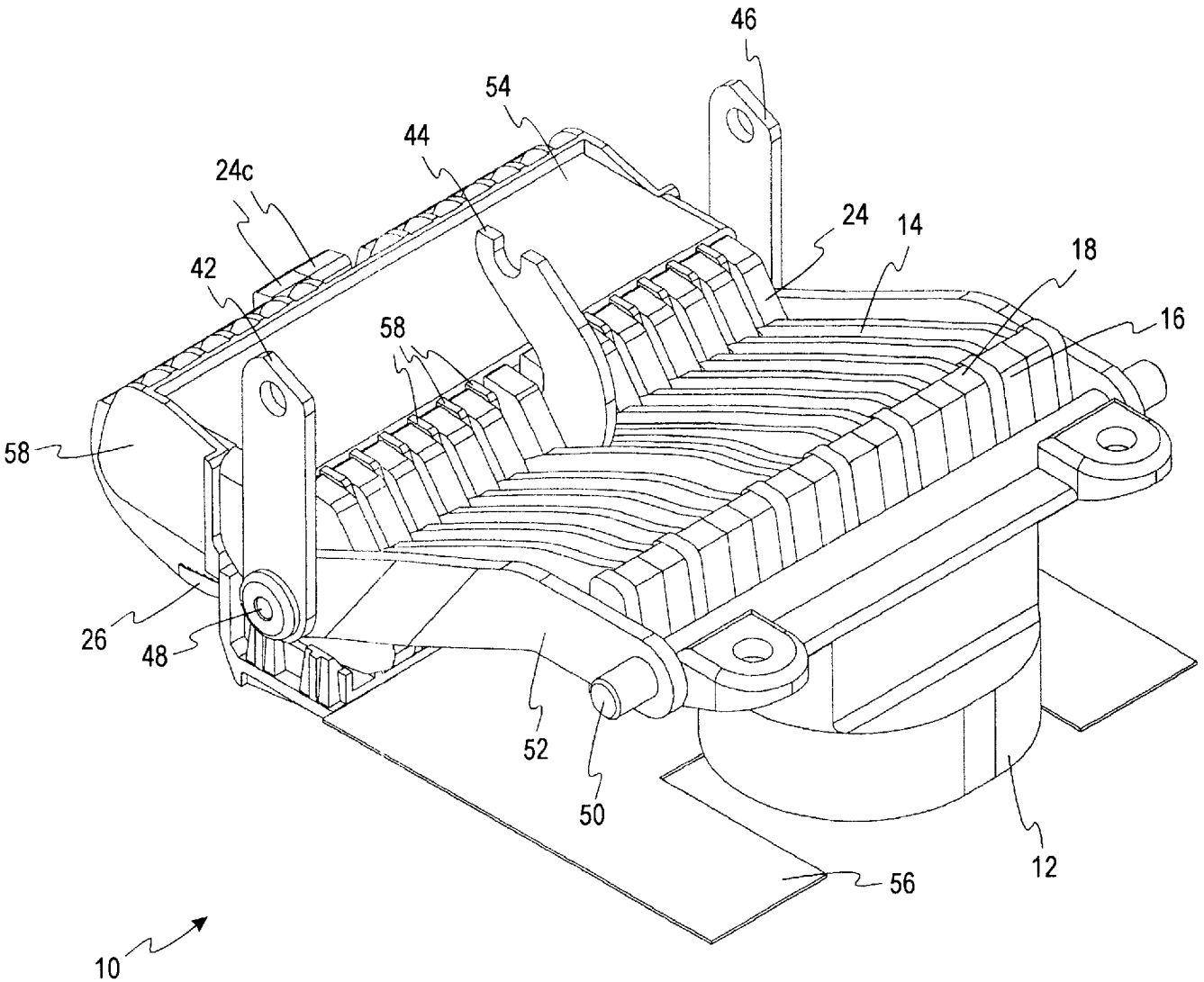
FIG. 1 shows a moveable contact pole or blade assembly in accordance with one object of the invention.
Figure 2:
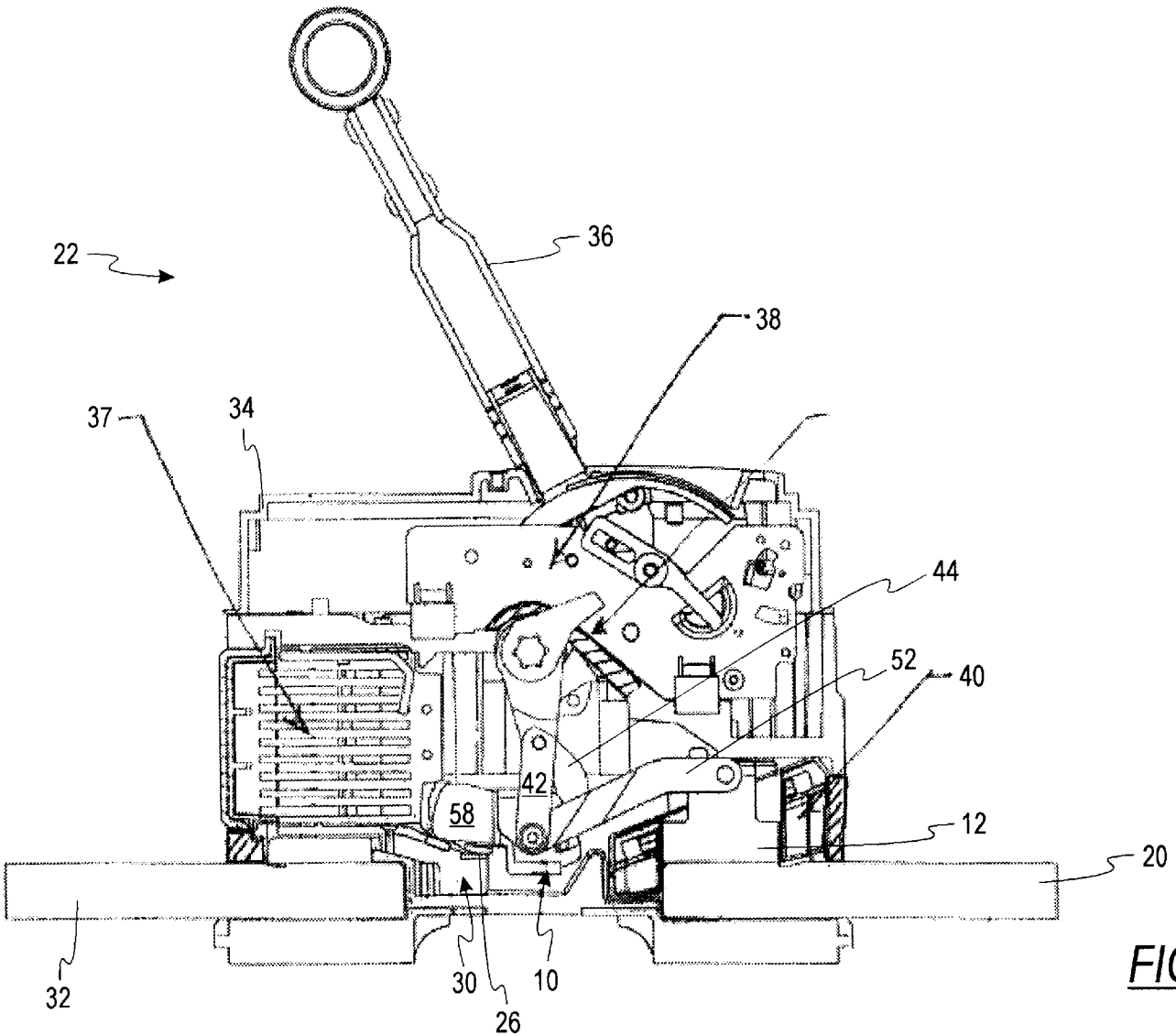
FIG. 2 is a partially broken-away somewhat simplified view of a circuit breaker assembly in which the moveable contact assembly may be utilized.

Referring now to the drawings, FIG. 1 shows a perspective view of a an assembled moveable contact assembly 10 in accordance with one embodiment of the invention. The assembly 10 includes a current transformer (CT) terminal 12, which is conductively coupled to a plurality of current carrying elements 14 which typically comprise so-called pigtails or braids, that is, braided copper conductors. These copper conductors are brazed or otherwise attached at one end thereof to solid copper and/or silver terminal elements 16, 18 which are brazed or otherwise affixed in electrically conductive contact with the casting which makes up the CT terminal 12 to establish conductive contact therewith. Referring briefly to FIG. 2, the CT terminal 12 is in turn securely fastened by bolting or other suitable means to one of the main current-carrying terminals 20 of the circuit breaker assembly 22 of which the moveable contact assembly is in part.

Figure 3:
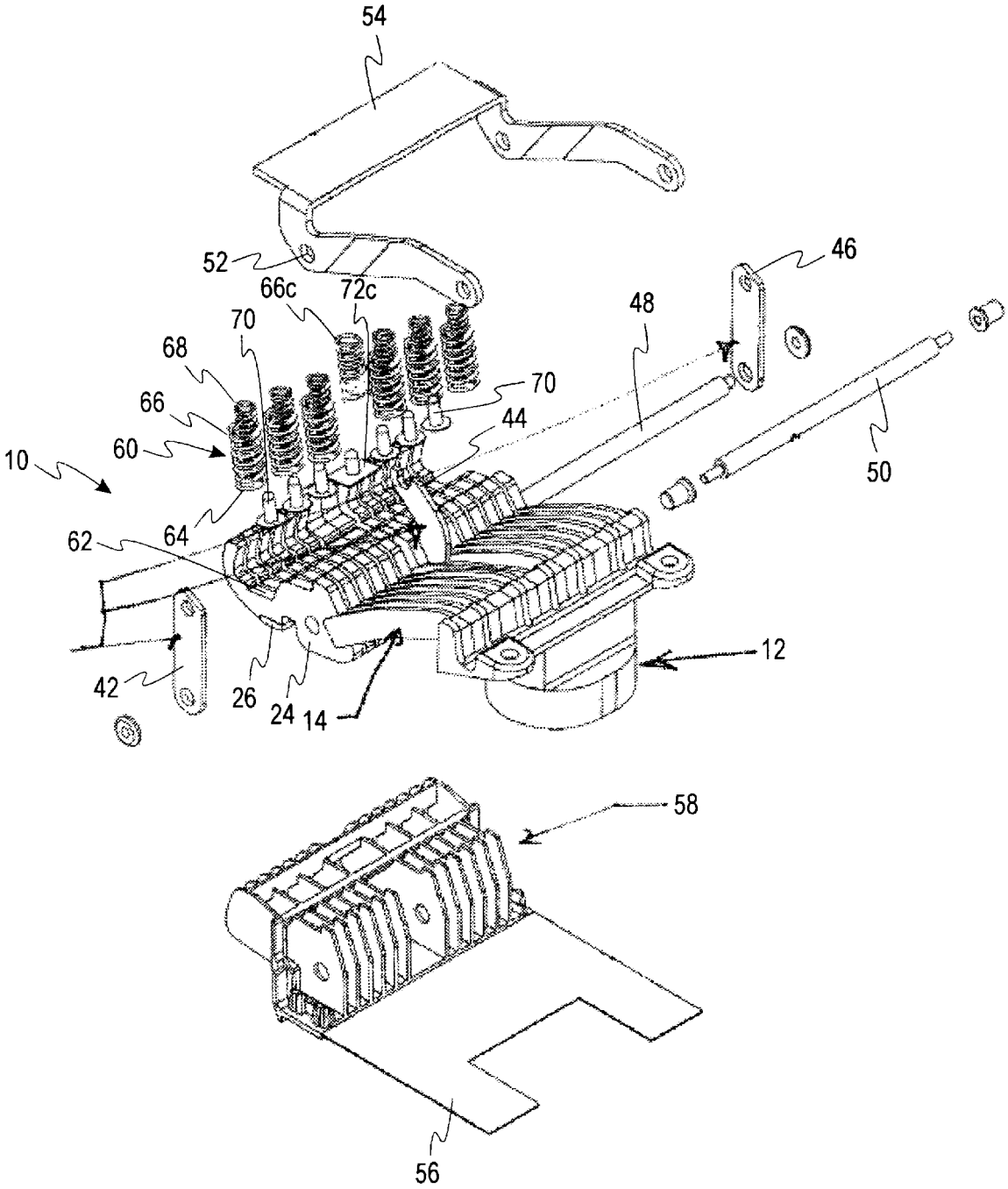
FIG. 3 is an exploded perspective view of the moveable contact assembly of FIG. 1.

Referring to FIGS. 1 and 3, opposite ends of the current carrying elements or braids 14 are brazed or otherwise affixed to respective blades 24 which are constructed of a copper material. Silver contacts 26 are sintered or otherwise attached to these current carrying blades 24. These contacts 26 are arranged to make and break the circuit by making or breaking contact with an aligned fixed contact 30 (see FIG. 2). The fixed contact 30 is in turn electrically coupled with the other current-carrying terminal 32 of the breaker 22. The breaker includes an arc chamber 37 adjacent the contacts 26, 30.

The breaker 22 further includes a protective cover or casing 34, a manually activatable handle 36 and an associated handle mechanism 38 which translates mechanical movement of the handle 36 into appropriate forces for manually opening and closing the breaker, that is, for moving the moveable contact assembly 10 into and out of electrically conductive contact with the fixed contact 30. The mechanism or mechanical assembly 38 is also responsive to a current transformer 40 or other sensing device for tripping the breaker, that is, moving the moveable contact assembly so as to move the contacts 26 out of electrically conductive contact with the fixed contact 30, in response to preselected overcurrent conditions and the like, as determined by the breaker design and ratings.

The moveable contact assembly 10 is mechanically coupled with the mechanism 38 through a set of links 42, 44 and 46 which are coupled mechanically with the blades through a pivot pin 48. This pivot pin 48 also serves to hold the blades 24 together in assembled condition. A second or blade carrier pivot pin 50 is aligned with a complimentary groove or through defined by the solid contact portions 16, 18 of the current carrying elements of pigtails 14 and the CT terminal 12. Coupled with the pivot pins 48 and 50 is a relatively rigid metallic blade carrier element 52 which defines at one end thereof an enlarged plate-like member 54 which provides a bearing surface for bearing against the blade springs 60 (see FIGS. 3, 4 and 6) (not seen in FIG. 1). The opposite end of these blade springs as will be explained presently, bear against the blades 24. Finally, a pigtail shield of nonconductive material 56 and a nonconductive, i.e., plastic or other dielectric material, blade separator 58 are provided to shield the pigtails 14 and hold the blades in parallel, spaced-apart condition to complete the assembly 10.

Figure 4:
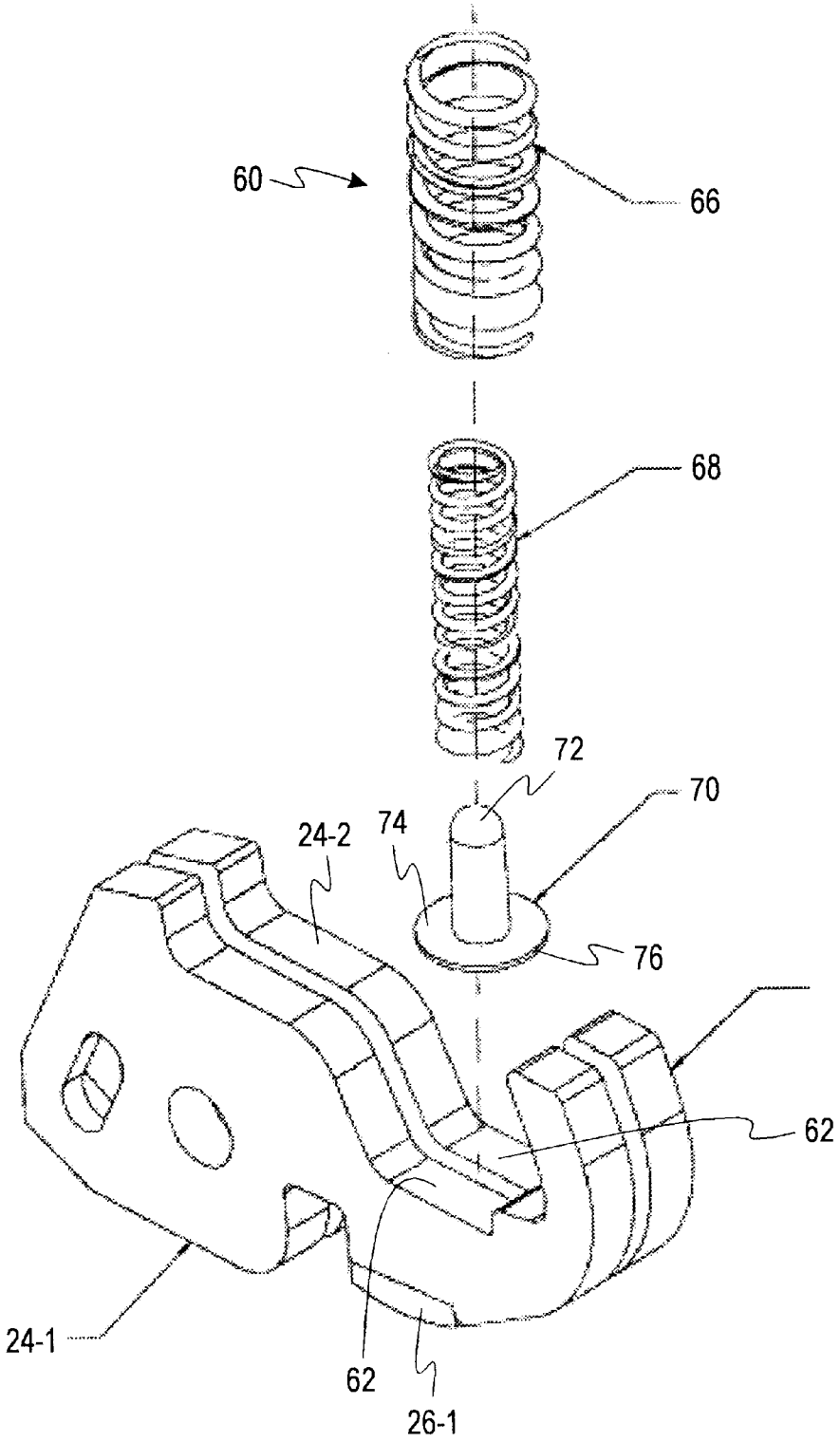
FIG. 4 is an enlarged partial view showing the configuration of the blade, spring protector and blade spring portions in accordance with one embodiment of the invention.

Referring now to FIGS. 3 and 4, further details of the moveable contact assembly in accordance with the embodiment of the invention described herein are illustrated.

Figure 6:
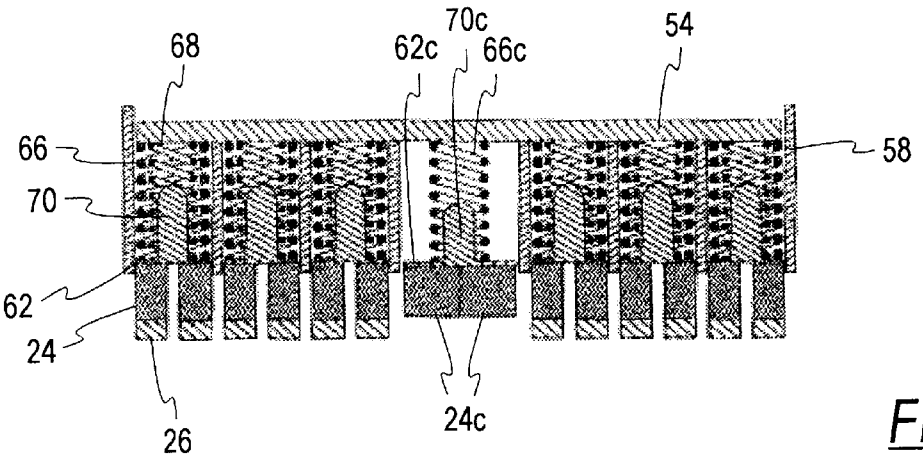
FIG. 6 is a sectional view taken generally along the line 6—6 of FIG. 5.

In FIGS. 3 and 4, the blade springs in accordance with one aspect of the invention are indicated generally by reference numeral 60. These springs or spring sets 60 are each arranged to bear against two adjacent ones of the blades 24 which are provided with bearing surfaces 62 for this purpose which bear against a facing surface 64 of each of these springs or spring sets 60. Advantageously, this permits a larger diameter spring having increased volume to be used, as compared with the situation where a separate spring is provided for each blade 24. Moreover, the provision of a larger volume spring set 60 permits an additional feature as indicated in FIGS. 3 and 6, namely, the provision of a pair of nesting springs to bear against each bearing surface or pair of bearing surfaces 62. These nesting springs include a first spring 66 which has an outer diameter approximately as great as the cross-sectional dimension across two of the adjacent blades 24 and an inner diameter, and a second or inner spring 68 which has an outer diameter somewhat smaller than the inner diameter spring 66 and is therefore nested within spring 66. The springs 66 and 68 are substantially identical in length. This nesting feature permits an even further increase in the amount of spring material in a given volume such that both nested springs may apply force to both blades at the same time, giving rise to desirable characteristics as mentioned above such as lower spring rate, lower stress concentration factors, etc. This also helps to make the springs somewhat more resistant to the buildup of excessive temperatures which may occur in the blades during high in-rush current periods which may last for up to several seconds.

In accordance with a further aspect of the invention, each spring set 60 is provided with a cooperating spring protector 70. As best viewed in FIG. 4, with respect to two 20 adjacent blades 26-1, 26-2, the spring protector 70 has an elongate projecting shaft portion 72 which has an outer diameter somewhat smaller than the inner diameter of the inner spring 68 so as to project therewith in to hold and align the springs relative to the bearing surfaces 62. An enlarged head portion 74 of the spring protector provides a bearing surface 76 to bear directly against the bearing surfaces of the blades 26-1 and 26-2. This consideration provides some further protective barrier between the springs 66, 68 and the blades 26-1, 26-2. This serves a number of purposes, among which are to permit the force of both springs 66, 68 to bear substantially equally upon the bearing surfaces 62 of the adjacent blades 26-1 and 26-2. Advantageously, this arrangement also serves as a protective barrier for the spring, to discourage the flow of plasma, molten material or the like which may exist during high-level short circuits, into the proximity of the springs. This arrangement also diminishes and retards the heat transfer to the blade springs during periods of high in-rush current.

Figure 5:
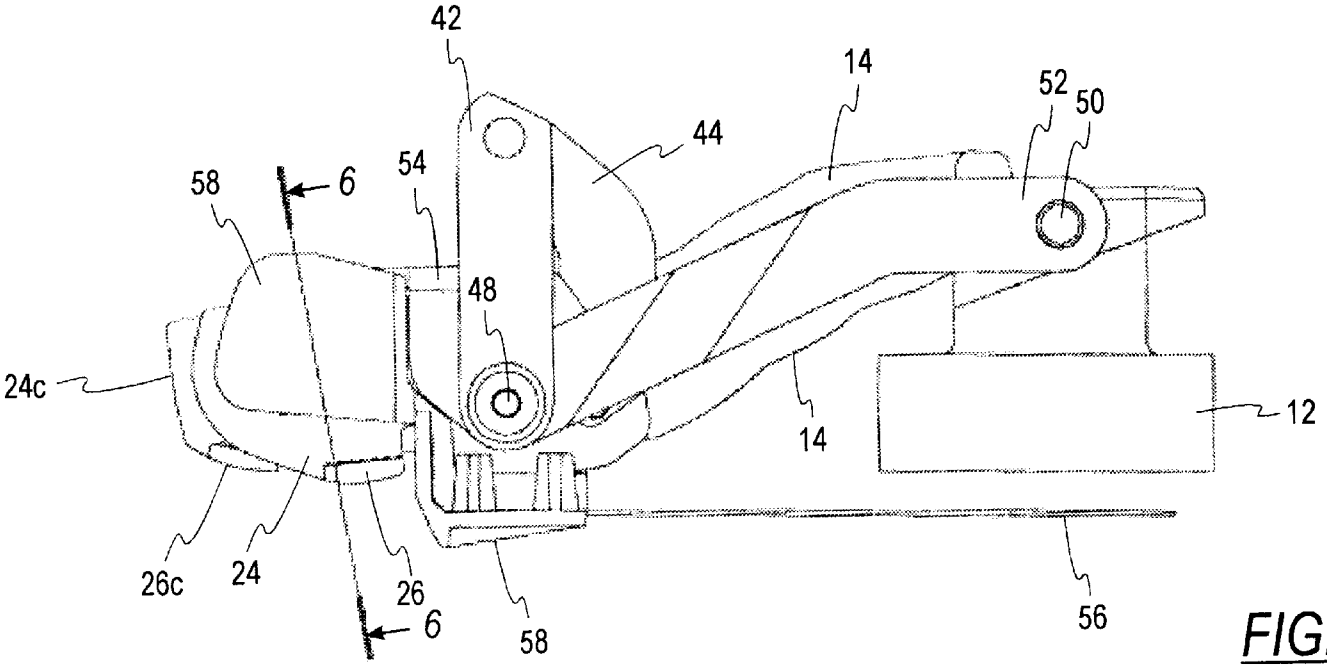
FIG. 5 is a side elevation of the assembled of the moveable contact assembly of FIG. 1.

In the embodiment illustrated herein, and as best viewed in FIG. 5, the central pair of blades 24*c* have a somewhat different configuration and shape and are offset somewhat from the other blades 24 in terms of their bearing surfaces 62*c* and their contact surfaces 26*c*. In the embodiment illustrated, a somewhat differently shaped spring protector with a substantially square head 72*c* is provided for these center blades, and the spring set for the center blades comprises but a single spring 66*c*. This, however, is a feature of the illustrated embodiment and is not necessary to the practice of the invention.

As best viewed in FIG. 6, the opposite ends of the springs bear against the blade carrier 54, as mentioned above. This amendment also causes the springs to be in a partly compressed condition when the movable contact 26 is not pressed against the fixed contact 30, and to provide increased contact forces when the two are engaged. This also causes the carrier 52 to pivot about pivot pin 48 so as to maintain the carrier pivot pin 50 in place. Conversely, the carrier pivot pin 50 maintains the desired compression force on the springs by the plate 54. In this regard, the length of the side arms of the carrier 52 deliver a lever-like action about the pivot 48, so as to maintain this force upon the plate 54.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A blade assembly for use in a circuit breaker, said blade assembly comprising:

a plurality of blades, including one or more pairs of adjacent side-by-side blades having coplanar contact surfaces and coplanar bearing surfaces;

at least one set of blade springs having one end in operative contact with said bearing surface of each of a pair of adjacent side-by-side ones of said blades, said at least one set of blade springs comprising at least one compression spring.

2. The assembly of claim 1 wherein said at least one set of blade springs comprises a first compression spring having a second inner diameter and a second outer diameter and a second compression spring having a first inner diameter and a first outer diameter less than the first inner diameter of said first compression spring, said second compression spring being nested inside of said first compression spring.

3. The assembly of claim 2 wherein each of said first and second compression springs is of substantially the same axial length.

4. The assembly of claim 1 and further including a spring protector interposed between said at least one set of blade springs and the ones of said bearing surfaces against which said at least one set of blade springs bears.

5. The assembly of claim 4 wherein said spring protector comprises an elongate cylindrical body having an inner diameter less than the inner diameter of said second spring and projecting into said second spring and having an enlarged head portion having cross-sectional dimensions greater than an outer diameter of said first spring and defining opposed bearing faces for bearing against said contact bearing surfaces and said first end of said spring set, respectively.

6. The assembly of claim 1 and further including an electrically non-conductive frame for holding a plurality of said pairs of blades in parallel spaced alignment.

7. The assembly of claim 6 and further including a conductive plate operatively coupled with said blades and with said frame and bearing against an opposite end of said at least one set of blade springs for maintaining said sets of springs in a partially compressed condition.

8. The assembly of claim 1 wherein one of said pairs of blades has contact surfaces and bearing surfaces respectively located in planes parallel and offset from the respective contact surfaces and bearing surfaces of the others of said plurality of blades.

9. The assembly of claim 8 wherein said one pair of blades is located substantially centrally of said plurality of blades.

10. A method of interrupting a circuit, said method comprising:

directing the current through a plurality of blades, including one or more pairs of adjacent side-by-side blades having coplanar contact surfaces and coplanar bearing surfaces; and providing a loading force on said blades using at least one set of blade springs, having one end in operative contact with said bearing surface of each of a pair of adjacent side-by-side blades, said at least one set of blade springs comprising at least one compression spring.

11. The method of claim 10 including, for said at least one set of blade springs nesting an inner compression spring having a first inner diameter and a first outer diameter within an outer compression spring having a second inner diameter and a second outer diameter greater than the first inner diameter of said inner compression spring.

12. The method of claim 11 wherein each of said first and second compression springs is of substantially the same axial length.

13. The method of claim 10 and further including interposing a spring protector between said at least one set of blade springs and the ones of said bearing surfaces against which said set of springs bears.

14. The method of claim 13 wherein interposing said spring protector comprises projecting an elongate cylindrical body portion of said spring protector, having an inner diameter less than the inner diameter of said inner spring into said inner spring and positioning an enlarged head portion of said spring protector having cross-sectional dimensions greater than an outer diameter of said outer spring, and defining opposed bearing faces, bearing against said contact bearing surfaces and said first end of said spring set, respectively.

15. The method of claim 10 and further including holding a plurality of said pairs of blades in parallel spaced alignment with an electrically non-conductive frame.

16. The method of claim 15 and further including operatively coupling a conductive plate with said blades and with said frame and bearing against an opposite end of said at least one set of blade springs for maintaining said at least one set blade of springs in a partially compressed condition.

17. The method of claim 10 including directing current through one pair of blades having contact surfaces and bearing surfaces respectively located in planes parallel and offset from the respective contact surfaces and bearing surfaces of the others of said plurality of blades.

18. The method of claim 17 including locating said one pair of blades substantially centrally of said plurality of blades.

19. A blade assembly for use in a circuit breaker, said blade assembly comprising:

means for directing the current through a plurality of blades, including one or more pairs of adjacent side-by-side blades having coplanar contact surfaces and coplanar bearing surfaces; and means for providing a loading force on said blades using at least one set of blade springs having one end in operative contact with said bearing surface of each of a pair of adjacent side-by-side blades, said at least one set of blade springs comprising at least one compression spring.

20. The assembly of claim 19 wherein including, for said at least one set of blade springs, means for nesting an inner compression spring having a first inner diameter and a first outer diameter within an outer compression spring having a second inner diameter and a second outer diameter greater than the first inner diameter of said inner compression spring.

21. The assembly of claim 20 wherein each of said first and second compression springs is of substantially the same axial length.

22. The assembly of claim 19 and further including spring protector means between each said set of blade springs and the ones of said bearing surfaces against which said set of springs bears.

23. The assembly of claim 22 wherein said spring protector means comprises an elongate cylindrical body portion having an inner diameter less than the inner diameter of said inner spring and projecting into said inner spring, and an enlarged head portion having cross-sectional dimensions greater than an outer diameter of said outer spring, and defining opposed bearing faces, bearing against said contact bearing surfaces and said first end of said at least one set of blade springs.

24. The assembly of claim 19 and further including means for holding a plurality of said pairs of blades in parallel spaced alignment with an electrically non-conductive frame.

25. The assembly of claim 24 and further including means for operatively coupling a conductive plate with said blades and with said frame and bearing against an opposite end of said at least one set of blade springs for maintaining said at least one set of blade springs in a partially compressed condition.

26. The assembly of claim 19 including means for directing current through one pair of blades having contact surfaces and bearing surfaces respectively located in planes parallel and offset from the respective contact surfaces and bearing surfaces of the others of said plurality of blades.

27. The assembly of claim 26 wherein said one pair of blades is located substantially centrally of said plurality of blades.

* * * * *